US011396399B2

(12) United States Patent
Amoros et al.

(10) Patent No.: US 11,396,399 B2
(45) Date of Patent: Jul. 26, 2022

(54) LOAD TRANSMITTER JIG

(71) Applicant: Hewlett-Packard Development Company, L.P., Spring, TX (US)

(72) Inventors: Elisabet Amoros, Sant Cugat del Valles (ES); Josep Abella Viviancos, Sant Cugat del Valles (ES); Carlos Fernando Caldas, Sant Cugat del Valles (ES); Laura Sofia Sardi, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 267 days.

(21) Appl. No.: 16/615,611

(22) PCT Filed: Jul. 25, 2017

(86) PCT No.: PCT/US2017/043707

§ 371 (c)(1),
(2) Date: Nov. 21, 2019

(87) PCT Pub. No.: WO2019/022718

PCT Pub. Date: Jan. 31, 2019

(65) Prior Publication Data

US 2020/0172288 A1 Jun. 4, 2020

(51) Int. Cl.
*B65D 19/38* (2006.01)
*B65D 19/00* (2006.01)

(52) U.S. Cl.
CPC ..... *B65D 19/385* (2013.01); *B65D 19/0002* (2013.01); *B65D 2519/00696* (2013.01); *B65D 2585/689* (2013.01)

(58) Field of Classification Search
CPC ..... B65D 19/0002; B65D 19/385; B65D 2519/00696; B65D 2585/689; B65D 85/68
See application file for complete search history.

(56) References Cited

U.S. PATENT DOCUMENTS 4,236,642 A * 12/1980 Klein ..... A47B 57/482 211/207
6,283,044 B1 * 9/2001 Apps ..... B29C 65/2061 108/57.25
7,748,540 B2 7/2010 Matsumoto et al.
8,256,615 B2 * 9/2012 Goda ..... B65D 81/056 206/386
9,107,299 B2 8/2015 Rayner et al.
(Continued)

FOREIGN PATENT DOCUMENTS

WO WO2019022718 1/2019

OTHER PUBLICATIONS

Repacking the DS 40 & DS 80 Printers, DNP Photo Imaging, Mar. 2015 < http://dnpphoto.com/Portals/0/Resources/REPACKING_DS40_80.pdf>.

*Primary Examiner* — Matthew W Ing
(74) *Attorney, Agent, or Firm* — HP Inc. Patent Department

(57) ABSTRACT

A fixation member comprises a support structure comprising a top surface; a first L-shaped projection extending from the top surface of the support structure; a second L-shaped projection extending from the top surface of the support structure; the first L-shaped projection and the second L-shaped projection each comprising a base surface and a side surface.

15 Claims, 10 Drawing Sheets

(56) References Cited

U.S. PATENT DOCUMENTS

| | | | | |
|---|---|---|---|---|
| 2002/0037195 | A1* | 3/2002 | Ajiki | F16B 7/187<br>403/403 |
| 2003/0061974 | A1* | 4/2003 | Smyers | B65D 19/0012<br>108/56.1 |
| 2006/0078475 | A1* | 4/2006 | Tai | B01L 9/527<br>422/400 |
| 2006/0189214 | A1* | 8/2006 | Maruyama | H01R 43/0256<br>439/676 |
| 2012/0032054 | A1* | 2/2012 | Huang | H05K 13/0084<br>248/346.5 |
| 2019/0248542 | A1* | 8/2019 | Goda | B65D 19/44 |
| 2020/0031558 | A1* | 1/2020 | Iwamoto | B65D 85/68 |

* cited by examiner

LOAD TRANSMITTER JIG

BACKGROUND

During shipping, a support assembly as part of a packaging system can protect a shipped object, such as a large-scale printer, from accidental damage. As part of the support assembly, a cuboid alignment of support beams can be mounted on top of a shipping pallet.

BRIEF DESCRIPTION OF THE DRAWINGS

The following detailed description will best be understood with reference to the drawings, wherein.

DETAILED DESCRIPTION

During the packaging of large-scale objects, such as a printer, the cuboid alignment of the support structure may involve alignment of large components at elevated positions. The use of an alignment means can hereby be employed for mounting or aligning the support structure. In some examples, a load transmitter jig or fixation member may be used to improve the alignment of the components in several dimensions.

The form of the load transmitter jig may support a positioning and alignment of the components of packaging arches as part of the support structure. An improved alignment of components of the support structure may reduce assembly times or associated costs, while it may also be advantageous for process quality or a security aspect during the assembly of the shipping structure, such as a more ergonomical mounting procedure.

In addition, a shipped object, such as a printer, may be protected from accidental damage due to a precise alignment of the components. The alignment may improve an ability of the support structure to accommodate compression or shear forces, and may hence preserve a structural integrity of the shipped object during shipment.

In addition, the fixation member may provide alignment or fixation options for protective parts of the support structure, such as spacers, which may reduce a translation of the shipped object during shipment, such as a transverse movement of a printer. Moreover, the fixation member may provide fixation options for mounting additional parts of the shipped object to the support structure, such as exchangeable parts or features of a printer.

The support structure may be employed for the packaging of all types of printer devices and printer equipment, including 2D and 3D (additive) printers.

Figure 1:
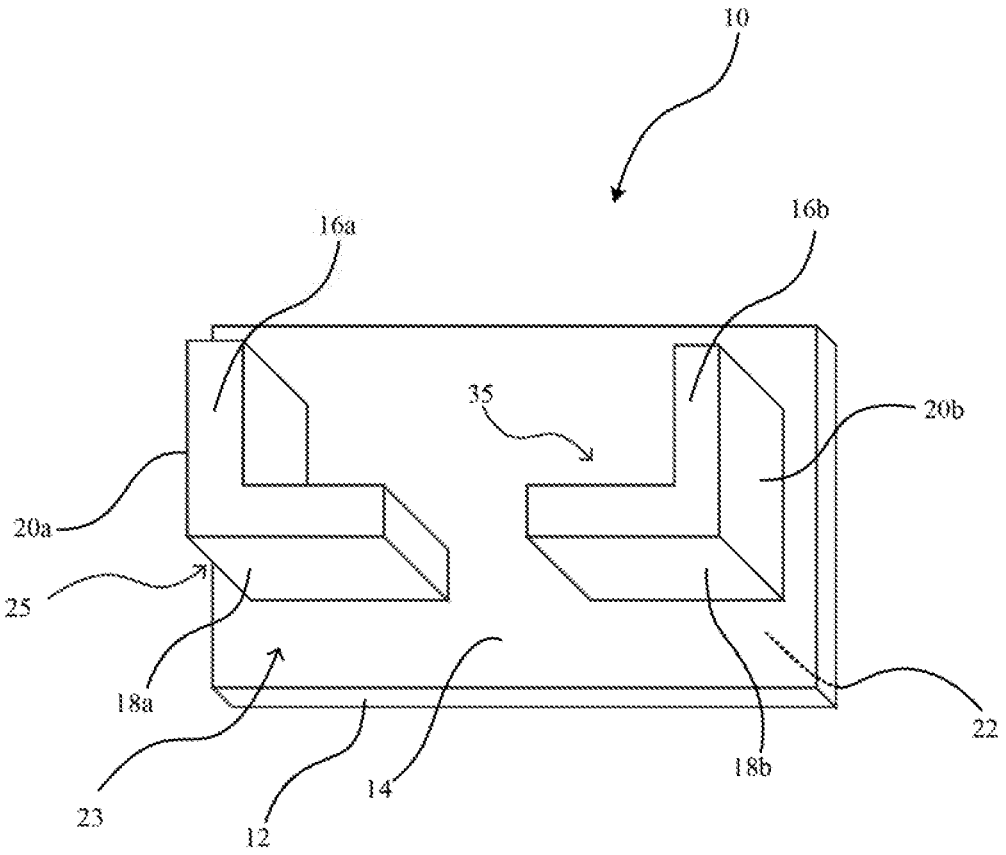
FIG. 1 illustrates a perspective view of a fixation member according to an example.

An example of a fixation member 10 is shown in FIG. 1. The fixation member 10 comprises a support structure 12 comprising a top surface 14, a first L-shaped projection 16*a* extending from the top surface 14 of the support structure 12, a second L-shaped projection 16*b* extending from the top surface 14 of the support structure 12, the first L-shaped projection 16*a* and the second L-shaped projection 16*b* each comprising a base surface 18*a*,18*b* and a side surface 20*a*,20*b*.

The fixation member 10 can support the alignment of features or components of a packaging assembly during mounting and transport. A degree of asymmetry in the arrangement of the fixation member 10 can allow for several mounting strategies with the same fixation member 10 and hence increase the flexibility of the assembly.

The fixation member 10 may be formed as one piece, which can reduce fabrication complexity and can increase structural integrity. Hence, the fixation member 10 may be a one-piece fixation member.

The support structure 12 of the fixation member 10 supports the at least two L-shaped projections 16*a*,16*b* and may support a beam mounted on a bottom surface 22 of the support structure 12, wherein the bottom surface 22 is on an opposite side of the support structure 12 with respect to the top surface 14.

As shown in FIG. 1, the top surface 14 of the support structure 12 may have a flat surface, which can be mounted to a flat surface of an external structure, such as an assembly component. However, the support structure may also comprise bulges or recesses, such as to align with a corresponding bulge or recess of an external structure or to locally modify the structural stability. Moreover, the top surface 14 of the support structure 12 may be a rough surface, which can modify a friction with respect to an external structure or to facilitate the mounting of the fixation member 10.

In FIG. 1, the support structure 12 is shown to have right angled corners. However, the corners of the support structure 12 may also be rounded, such as to reduce a risk of user injury or damage to an external part. In addition, the shape of the base area of the support structure 12 may be adapted to a fixation system, and may hence deviate from the rectangular shape shown in FIG. 1. For example, the base area may be square, trapezoid, round or triangular, and may have cut edges.

The L-shaped projections 16*a*,16*b* extending from the support structure 12 may be angular pieces or elbow fittings. They may comprise mathematical cylinders, wherein a three-dimensional structure may be formed by a parallel displacement of a cross-section with an L-shape from a first surface along a straight vector towards an identically shaped second surface, the first and second surfaces being L-shaped.

The cross-section of the first L-shaped projection 16*a* and the cross-section of the second L-shaped projection 16*b* may be mathematically similar, congruent, or identical L-shapes. In some examples, the cross-sections of the L-shaped projections 16*a*,16*b* may also be distorted with respect to each other due to a non-isometric transformation.

The straight vector of the first L-shaped projection 16*a* may be different from or equal to the straight vector of the second L-shaped projection 16*b* with respect to orientation and length. As an example, the straight vector may be along the normal of the top surface 14 of the support structure 12, or, in other words, the L-shaped projections 16*a*,16*b* may extend along the normal of the top surface 14 from the top surface 14 of the support structure 12.

In an example depicted in FIG. 1, the first L-shaped projection 16*a* is a mirror image of the second L-shaped projection 16*b*. In particular, the first and the second L-shaped projections 16*a*,16*b* may be arranged with mirror symmetry with respect to a plane perpendicular to the top surface of the support structure.

The L-shape (of the cross-section) may be constructed from two overlapping rectangles, wherein a longer side of each rectangle is oriented in a different spatial direction and wherein the two rectangles may share one common corner. However, the corner may also be rounded, cut or comprise an extruded feature without deviating from the L-shape of the L-shaped projection 16*a*,16*b*. The common corner may then be a virtual corner formed by the projections of the longest outer sides of the two rectangles.

In other words, the L-shape may be constructed from a polygon with six corners that is characterized by an inner angle that is greater than 180°. For example, one inner angle of the L-shape may be 270° and five other inner angles may be 90° as shown in FIG. 1. As before, the corners may be rounded, cut or comprise an extruded feature without deviating from the L-shape.

The first and second L-shaped projections 16*a*,16*b* further comprise the base surface 18*a*,18*b* and the side surface 20*a*,20*b* that may be outer surfaces of the L-shaped projections 16*a*,16*b*. Accordingly, an intersection of tangential planes corresponding to the base surface 18*a*,18*b* and the side surface 20*a*,20*b* may lie along the common corner. In other words, the base surface 18*a*,18*b* and the side surface 20*a*,20*b* may be outer surfaces of the L-shape that meet at the corner of the L-shape, which is opposite the corner associated with an inner angle greater than 180°.

The L-shape of the L-shaped projections 16*a*,16*b* allows for a plurality of mounting strategies for mounting an external feature or a component of a packaging assembly to the fixation member 10 with the same fixation member 10.

For example, the base surface 18*a*,18*b* and the side surface 20*a*,20*b* of the L-shaped projections 16*a*,16*b* may each provide a mounting support to connect the fixation member 10 to an external feature. The fixation member 10 may thereby provide a fixation along several different spatial directions. In addition, the fixation member 10 may allow for self-alignment of the external feature with the fixation member 10 by connecting a surface of the external feature to the top surface 14 of the support structure 12 and a different surface of the external feature to the base surface 18*a*,18*b* or the side surface 20*a*,20*b* of the first or the second L-shaped projection 16*a*,16*b*.

The external feature may be a structural component whose alignment is supported by the fixation member 10. For example, the external feature may be a component or part of a construction such as a plate or a beam. As an example, a packaging structure may comprise an alignment of beams on top of a shipping pallet. The fixation member 10 may be used to fix the beams to the pallet, align several beams with respect to each other, or provide mounting support for additional beams to accommodate shear forces. In the example of the shipping pallet, the fixation member 10 may be used with arbitrary combinations of materials for the pallet and the beams. For example, the beams or the pallet may be made from an organic material such as wood, a composite material such as plywood, a plastic, a metal, or the like.

The (self-)alignment of the external features can be supported by the arrangement of the L-shaped projections 16*a*,16*b* on top of the support structure 12. For example, a cavity or mounting space 23 may be formed between a surface of an L-shaped projection 16*a*,16*b* and the top surface 14 of the support structure 12. The cavity 23 may constrain the movement of the external feature with respect to the fixation member 10, and may support the self-alignment of the external feature to the fixation member 10.

In an example shown in FIG. 1 the base surface 18*a* of the first L-shaped projection 16*a* or the base surface 18*b* of the second L-shaped projection 16*b* may not be aligned with an edge of the support structure 12. A mounting space or cavity 23 may be formed between the base surface 18*a*,18*b* of either or both the first or the second L-shaped projection 16*a*,16*b*, and the top surface 14 of the support structure 12. The cavity 23 may support the self-alignment of the external feature to the fixation member 10 with respect to the base surface 18*a*,18*b* and the top surface 14.

In addition, the base surface 18*a* of the first L-shaped projection 16*a* and the base surface 18*b* of the second L-shaped projection 16*b* may also define a common flat plane. Accordingly, the cavity 23 is formed between both of the base surfaces 18*a*,18*b* of the L-shaped projection 16*a*, 16*b* and the top surface 14 of the support structure 12.

In some examples, the first L-shaped projection 16*a* and the second L-shaped projection 16*b* may overlap or be connected by extruded features, such that the base surfaces 18*a*,18*b* are connected, which may increase a structural integrity of the fixation member 10. In other examples, the first L-shaped projection 16*a* and the second L-shaped projection 16*b* are connected via the top surface 14 and the fixation member 10 comprises a gap between the first L-shaped projection 16*a* and the second L-shaped projection 16*b*. The gap may separate the first L-shaped projection 16*a* and the second L-shaped projection 16*b*. The gap may decrease a weight of the fixation member 10, may provide arrangement or alignment options for external features, or may give a visual indication of directionality for alignment.

In addition, the side surface 20*a* of the first L-shaped projection 16*a* or the side surface 20*b* of the second L-shaped projection 16*b* may also not be aligned with an edge of the support structure 12. A side cavity 25 or side mounting space may be formed between the side surface 20*a*,20*b* of the first or the second L-shaped projection 16*a*,16*b* and the top surface 14 of the support structure 12.

Figure 2:
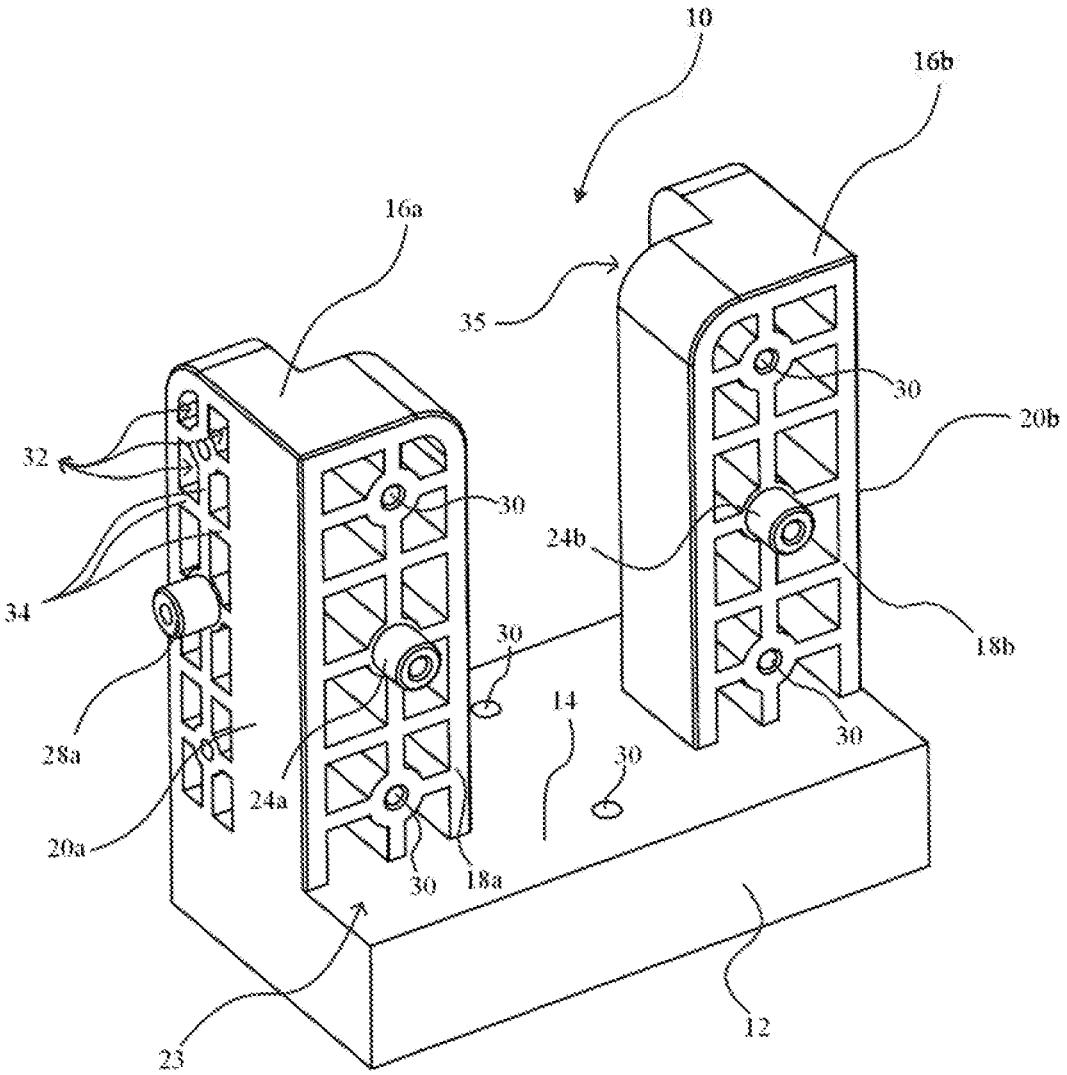
FIG. 2 illustrates a perspective view of a fixation member according to a further example.

Referring now to FIG. 2, an illustration of an example of a fixation member 10 is shown that is generally similar to the fixation member of FIG. 1, and the same reference numerals are used to designate corresponding parts. In addition, reference is made to FIGS. 3-6 which may be considered to show different views of a similar fixation member 10 as the one shown in FIG. 2, or different views of one and the same fixation member 10.

In some examples, the side surface 20*a* of the first L-shaped projection 16*a* or the side surface 20*b* of the second L-shaped 16*b* projection may be aligned with an edge of the support structure 12, as shown in FIG. 2. In this configuration, the alignment or placement of an external feature may not be constrained by the support structure 12, when the external feature is attached to or aligned with the side surfaces 20*a*,20*b*.

An example of a fixation member 10 may further comprise a mounting protrusion 24*a*,24*b*; 26*a*,26*b*; 28*a*,28*b*, such as a base-side mounting protrusion 24*a*,24*b*, a bottom-side mounting protrusion 26*a*,26*b* (not shown in FIG. 2, but shown in the examples according to FIGS. 3, 4, and 6), or a flank mounting protrusion 28*a*,28*b*. The mounting protrusion may engage a corresponding hole of an external feature during mounting and may hence be used to align the fixation member 10 and the external feature.

The fixation member 10 may also comprise several mounting protrusions on equal or different surfaces of the fixation member 10. Thus, the alignment of an external feature may be supported by at least one mounting protrusion or the alignment of the external feature may be supported by one of the mounting protrusions in different spatial directions. Supporting the alignment of the external feature with several mounting protrusions may result in a stricter alignment, while supporting the alignment of the external feature with one mounting protrusion may allow greater alignment tolerances.

The mounting protrusion may be a mathematical cylinder protruding from a surface of the fixation member 10. The mounting protrusion may engage a corresponding hole of an external feature, which can support the self-alignment of the external feature. The cross-section of the mounting protrusion may be circular, rectangular, triangular, cross-shaped, or star-shaped, a combination of several shapes, or the like and may comprise a hole. For example, the mounting protrusion may be a hollow cylinder as shown in FIG. 2. However, the mounting protrusion may also comprise a mounting bulge with an arbitrary shape, such as a section of a sphere, or an extruded feature with a receding cross-section, such as a cone. Moreover, the mounting protrusion may have a different shape than a corresponding hole of the external feature, such as a cross-shaped mounting protrusion engaging a circular hole.

A circular cross-section of the mounting protrusion may allow a flexible alignment of an external feature within a plane along the respective surface that the mounting protrusion extends from, while a different shape may result in a stricter alignment of the external feature. A receding cross-section may increase an initial alignment tolerance of the external feature to the fixation member 10, while a shape corresponding to a mathematical cylinder may provide a more constraining fixation of the external feature with respect to the fixation member 10.

As shown in the example of FIG. 2, the mounting protrusion may be a base-side mounting protrusion 24*a*,24*b* extending from the base surface 18*a* of the first L-shaped projection 16*a* or the base surface 18*b* of the second L-shaped projection 16*b*.

Particularly, the fixation member 10 may comprise a first base-side mounting protrusion 24*a* extending from the base surface 18*a* of the first L-shaped projection 16*a* and a second base side mounting protrusion 24*b* extending from the base surface 18*b* of the second L-shaped projection 16*b*. Hence, an external feature may be aligned to both of the first and second L-shaped projections 16*a*, 16*b* at the same time or two external features may separately be aligned to the first and second L-shaped projections 16*a*, 16*b*, respectively.

Figure 3:
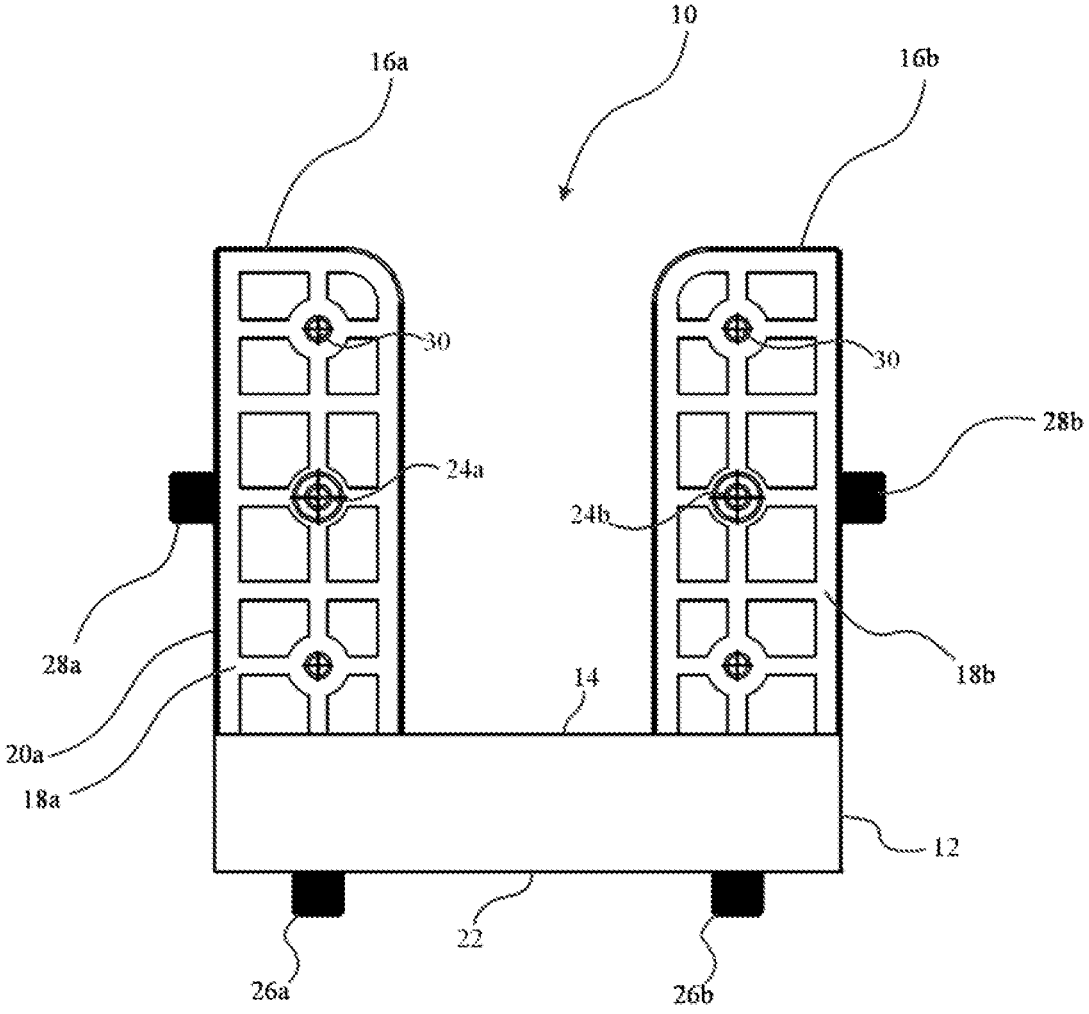
FIG. 3 illustrates a front view of a fixation member according to an example.
Figure 4:
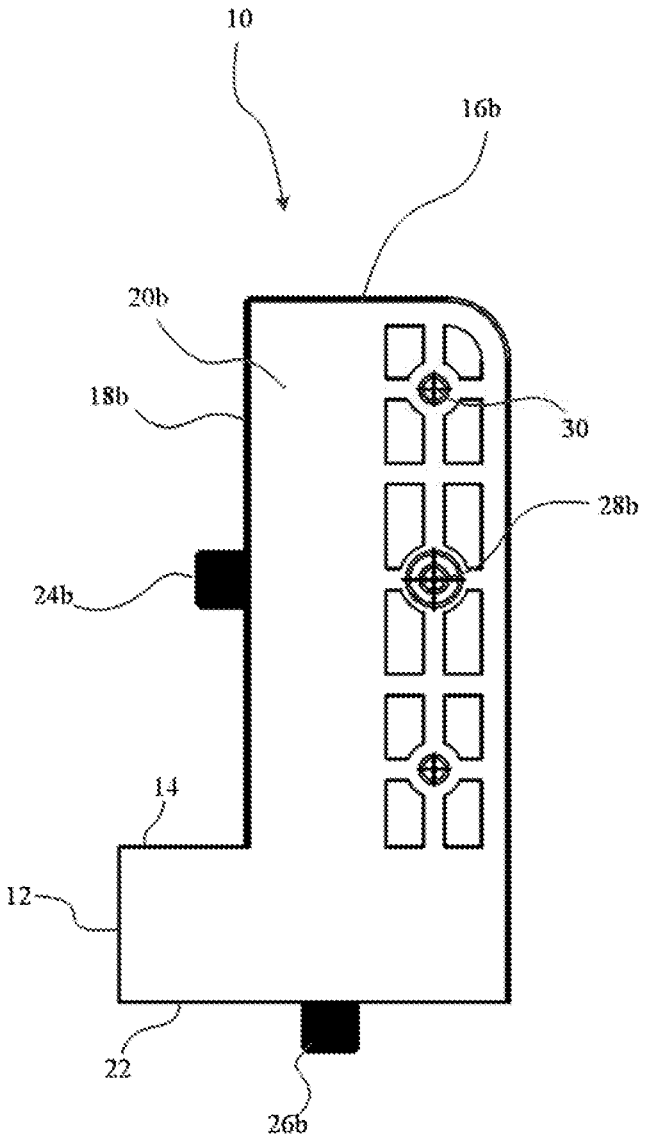
FIG. 4 illustrates a side view of a fixation member according to an example.
Figure 5:
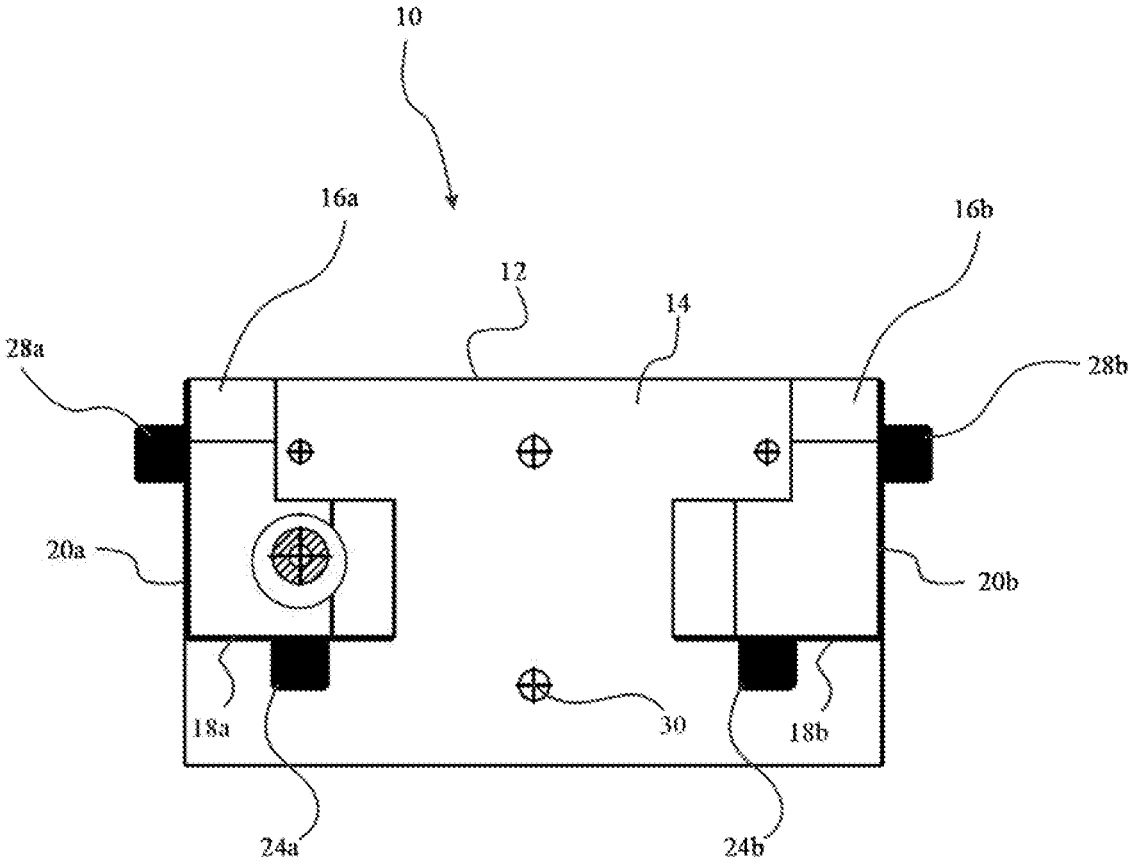
FIG. 5 illustrates a top view of a fixation member according to an example.

Further, as shown in the side views of the fixation member 10 according to FIGS. 3 and 4, the mounting protrusion may be a bottom-side mounting protrusion 26*a*,26*b* extending from a bottom surface 22 of the support structure 12. The bottom-side mounting protrusion 26*a*,26*b* can support the self-alignment of a further external feature to the bottom surface 22 of the support structure 12. For example, a horizontal beam of a support assembly may be aligned in a cuboid structure, by engaging holes of the horizontal beam with the bottom-side mounting protrusion 26*a*,26*b* of several fixation members 10 in an elevated position of the assembly.

Referring to FIGS. 2, 3 and 4, the mounting protrusion may be a flank mounting protrusion 28*a*,28*b* extending from the side surface 20*a* of the first L-shaped projection 16*a* or the side surface 20*b* of the second L-shaped projection 16*b*. The flank mounting protrusion 28*a*,28*b* may be used as an alignment means for a supporting component, such as a diagonal beam for accommodating shear forces in a cuboid assembly.

As shown in FIG. 2, the fixation member 10 may further comprise a fixation hole 30. The fixation hole 30 penetrates the fixation member 10 between surfaces of the fixation member 10 as illustrated in the top and bottom views of the fixation member 10 according to FIGS. 5 and 6.

The fixation hole 30 can provide a guide for a connection piece, such as a screw or the like, to fix an external feature to the fixation member 10. Such a fixation may increase a rigidity of the assembly. The fixation hole 30 may be adapted to the connection piece, such as having a circular cross-section.

The surfaces may be on opposite side of the fixation member 10. The surfaces may comprise the top surface, the base surface, or the side surface.

The fixation member 10 may be made from a plastic, a metal, an organic material, a composite material, or the like. For example, the fixation member 10 may be made from a high-impact plastic, an iron based metal, or wood. The material can be selected according to structural characteristics such as flexibility, rigidity, compatibility with further components of an assembly, weight, cost, or the like.

A plastic fixation member 10 may be injection molded, 3-D-printed, or extruded and may hence be produced with arbitrary detail and have a low production cost. For example, when used in a packaging support structure, a plastic fixation member 10 may be an advantageous tradeoff or compromise between structural integrity, modelling difficulty, material cost and/or weight.

As illustrated in FIGS. 2-6, the fixation member 10 may further comprise a plurality of voids 32 in the first and second L-shaped projections 16*a*,16*b* and the support structure 12, the voids 32 defining a plurality of webs 34 between adjacent voids 32.

The voids 32 and the webs 34 may improve the characteristics of the fixation member 10 during fabrication. For example, the webs may have a similar thickness, such as to reduce a warping effect on the fixation member 10 during injection molding. Furthermore, the voids 32 may reduce the weight or the material cost of the fixation member 10. In FIG. 1, the voids 32 are aligned in a rectangular pattern; however, the voids 32 may have an arbitrary shape, such as a honeycomb or triangular shape. In addition, the voids may or may not fully penetrate the fixation member 10, such as to increase a structural rigidity or to offer further alignment options.

As depicted in the example of FIG. 4, the side profile of the fixation member 10 may be L-shaped. In this example, the base surfaces 18*a*,18*b* of the first L-shaped projection 16*a* and second L-shaped projection 16*b* are not aligned with an edge of the support structure 12, while the opposing front surface that is opposite of the base surface is aligned with an edge of the support structure 12, which can reduce a footprint of the fixation member 10.

The fixation member 10 may be used as a load transmitter jig 10.

Figure 7:
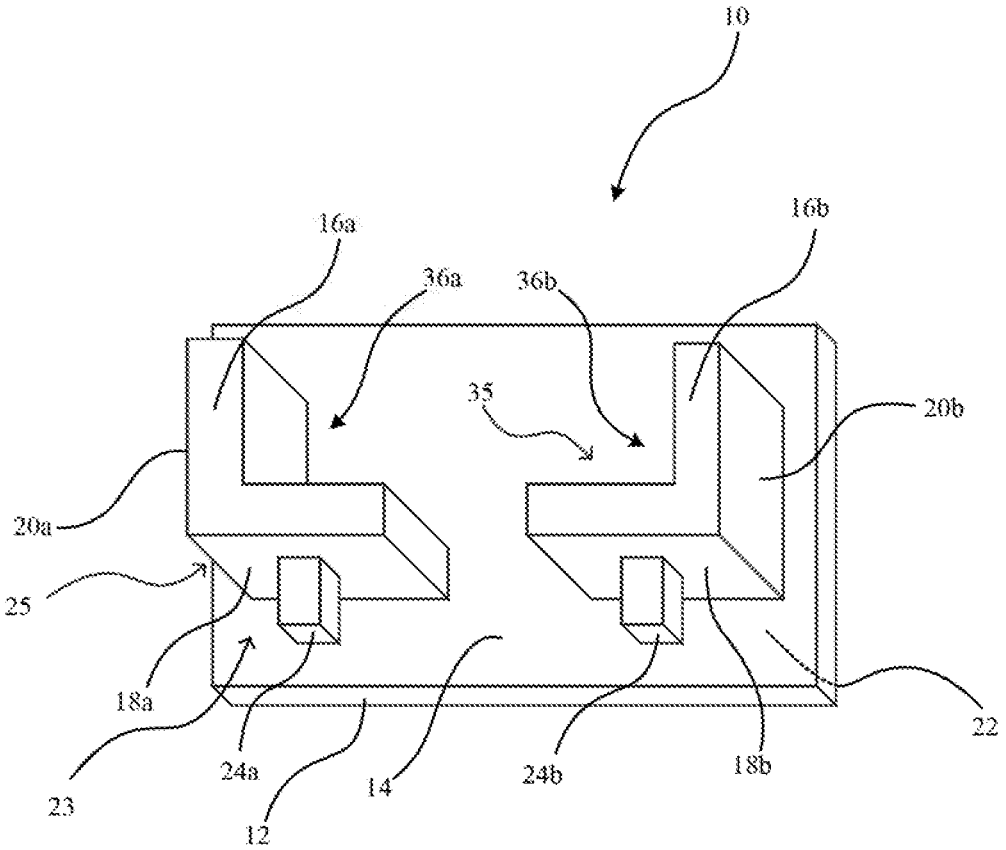
FIG. 7 illustrates a perspective view of a load transmitter jig according to an example.

As shown in FIG. 7, a load transmitter jig 10 comprises a principal plate 12 with a top surface 14 and a bottom surface 22 on opposite sides of the principal plate 12; a first L-shaped projection 16*a* extending from the top surface 14 of the principal plate 12; a second L-shaped projection 16*b* extending from the top surface 14 of the principal plate 12;

a beam fixation cavity 23 or beam fixation mounting space formed by a portion of the top surface 14 of the principal plate 12 and a common plane defined by parallel base surfaces 18*a*,18*b* of the first L-shaped projection 16*a* and the second L-shaped projection 16*b*; wherein the beam fixation cavity 23 comprises a cavity mounting protrusion 24*a*,24*b*, the cavity mounting protrusion 24*a*,24*b* extending from the common plane of the first L-shaped projection 16*a* and the second L-shaped projection 16*b*; the first L-shaped projection 16*a* and the second L-shaped projection 16*b* defining a further cavity 35 or further mounting space opposite of the beam fixation cavity 23 with respect to the common plane, wherein the further cavity 35 is formed by two inner surfaces 36*a*,36*b* of each of the first L-shaped projection 16*a* and the second L-shaped projection 16*b*, and the top surface 14 of the principal plate 12.

The inner surfaces 36*a*,36*b* of the first L-shaped projection 16*a* and the second L-shaped projection 16*b* are opposite of the base surfaces 18*a*,18*b* and the side (flank) surfaces 20*a*,20*b* of the first L-shaped projection 16*a* and the second L-shaped projection 16*b*. In other words, the inner surfaces 36*a*,36*b* or their projections meet at the corner of the L-shape, which is associated with an inner angle greater than 180°.

As explained with reference to the fixation member 10 of FIG. 2, a cavity 23 such as the beam fixation cavity 23 may be used to fix an external feature, such as a beam, to the load transmitter jig 10. The external feature can thereby be self-aligned to the load transmitter jig 10.

The alignment of the external feature to the load transmitter jig 10 may be supported by the cavity mounting protrusions 24*a*,24*b* that may engage a corresponding hole of the external feature, such as a hole of a beam.

The further cavity 35 of the load transmitter jig 10 may be used to facilitate a connection between the fixation member 10 and an external feature connected to the base surfaces 18*a*, 18*b* or a flank 20*a*,20*b* of the first L-shaped projection 16*a* or the second L-shaped projection 16*b*. For example, the further cavity 35 may provide a space for aligning or performing a screw connection between the fixation member 10 and the external feature.

However, the further cavity 35 of the load transmitter jig 10 may also provide an alignment possibility for an external feature, such as a beam arranged at least partially within the further cavity 35. For example, a beam whose width corresponds to the distance between inner surfaces 36*a*,36*b* of the first L-shaped projection 16*a* and second L-shaped projection 16*b* may be wedged into the further cavity 35. Moreover, the further cavity 35 may also provide a mounting support for other features of an assembly, such as a spacer, a diagonal beam, or an equipment holder.

In addition, the load transmitter jig 10 may comprise further features of the fixation member 10 as described above with reference to FIGS. 1-6.

Figure 6:
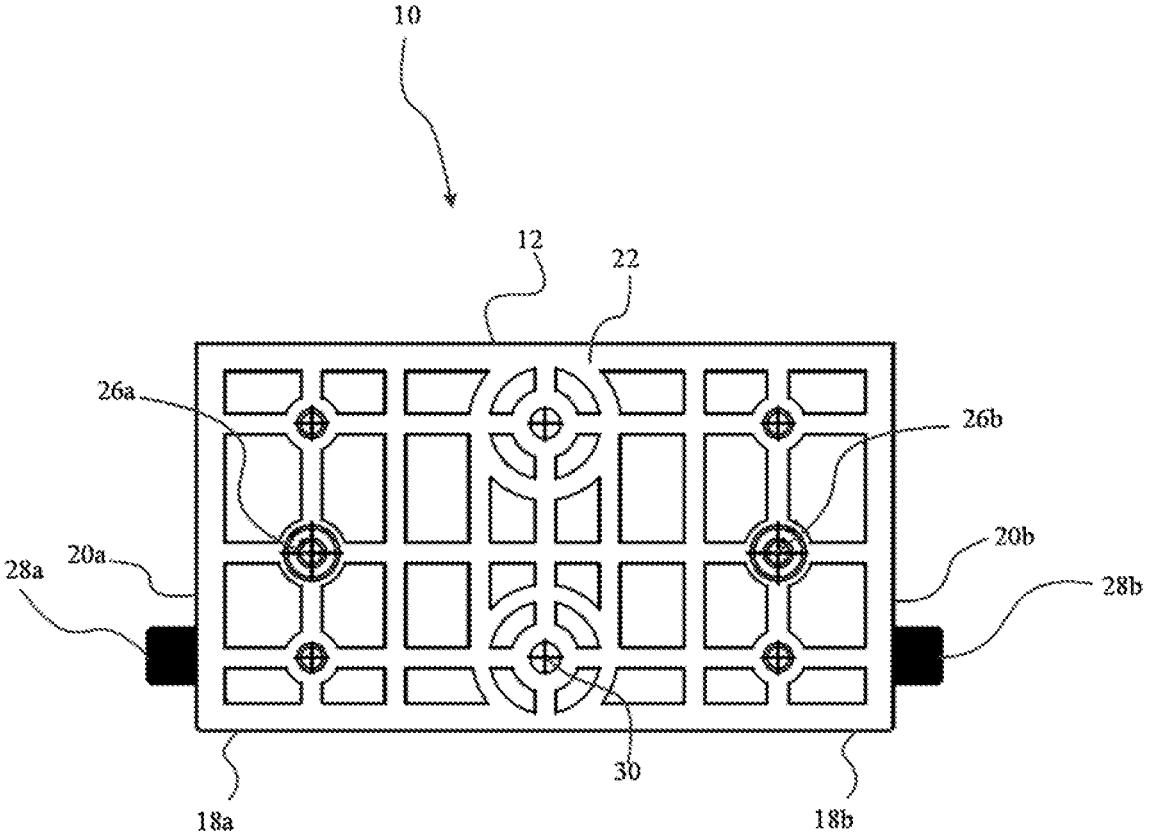
FIG. 6 illustrates a bottom view of a fixation member according to an example.

For example, the load transmitter jig 10 may further comprise a bottom mounting protrusion (such as the bottom-side mounting protrusions 26*a*,26*b* shown in FIGS. 3, 4, and 6) extending from the bottom surface 22 of the principal plate 12, the bottom surface 22 being opposite the top surface 14, such as to fix or align an external feature to the bottom surface 22 of the load transmitter jig 10.

In some examples, the load transmitter jig 10 may comprise a flank mounting protrusion (such as the flank mounting protrusions 28*a*,28*b* shown in FIGS. 2-6) extending from the first L-shaped projection 16*a* or the second L-shaped projection 16*b* in a different direction than the cavity mounting protrusion 24*a*,24*b*. The flank protrusion may extend from a side surface 20*a*,20*b* of the first L-shaped projection 16*a* or the second L-shaped projection 16*b*. The flank mounting protrusion 28*a*,28*b* may be used to align or fix an external feature to the flank of the load transmitter jig 10.

In some examples, the load transmitter jig 10 may be a one-piece load transmitter jig. The one-piece load transmitter jig may be fabricated from one piece. A one-piece load transmitter jig may be easier to produce or may have improved structural integrity with respect to a composite piece.

In some examples, the load transmitter jig 10 or the fixation member 10 are used as load transmission or alignment means for a printer packing support structure. The above described structural features may then be adapted in a method for aligning external features, such as beams, of an assembly, in particular components of a packaging structure or a printer packaging structure.

Figure 8:
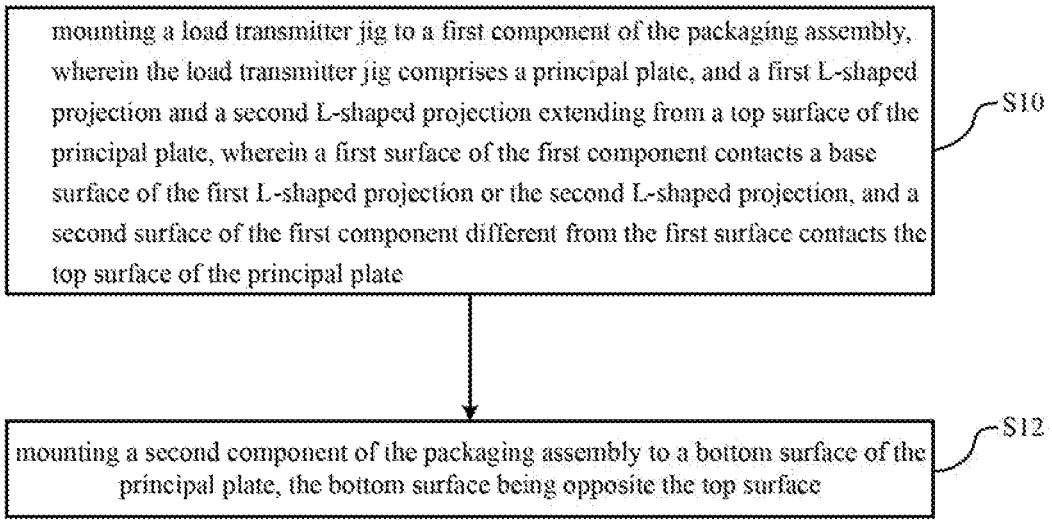
FIG. 8 depicts a flow diagram of a method for aligning components of a packaging assembly.

As shown in FIG. 8, a method for aligning components of a packaging assembly comprises mounting S10 a load transmitter jig 10 to a first component, wherein the load transmitter jig 10 comprises a principal plate 12, and a first L-shaped projection 16*a* and a second L-shaped projection 16*b* extending from a top surface 14 of the principal plate 12, wherein a first surface of the first component contacts a base surface 18*a*,18*b* of the first L-shaped projection 16*a* or the second L-shaped projection 16*b*, and a second surface of the first component contacts the top surface 14 of the principal plate 12, wherein the first surface and the second surface of the first component may be different; and mounting S12 a second component to a bottom surface 22 of the principal plate 12, the bottom surface 22 being opposite the top surface 14.

Figure 9:
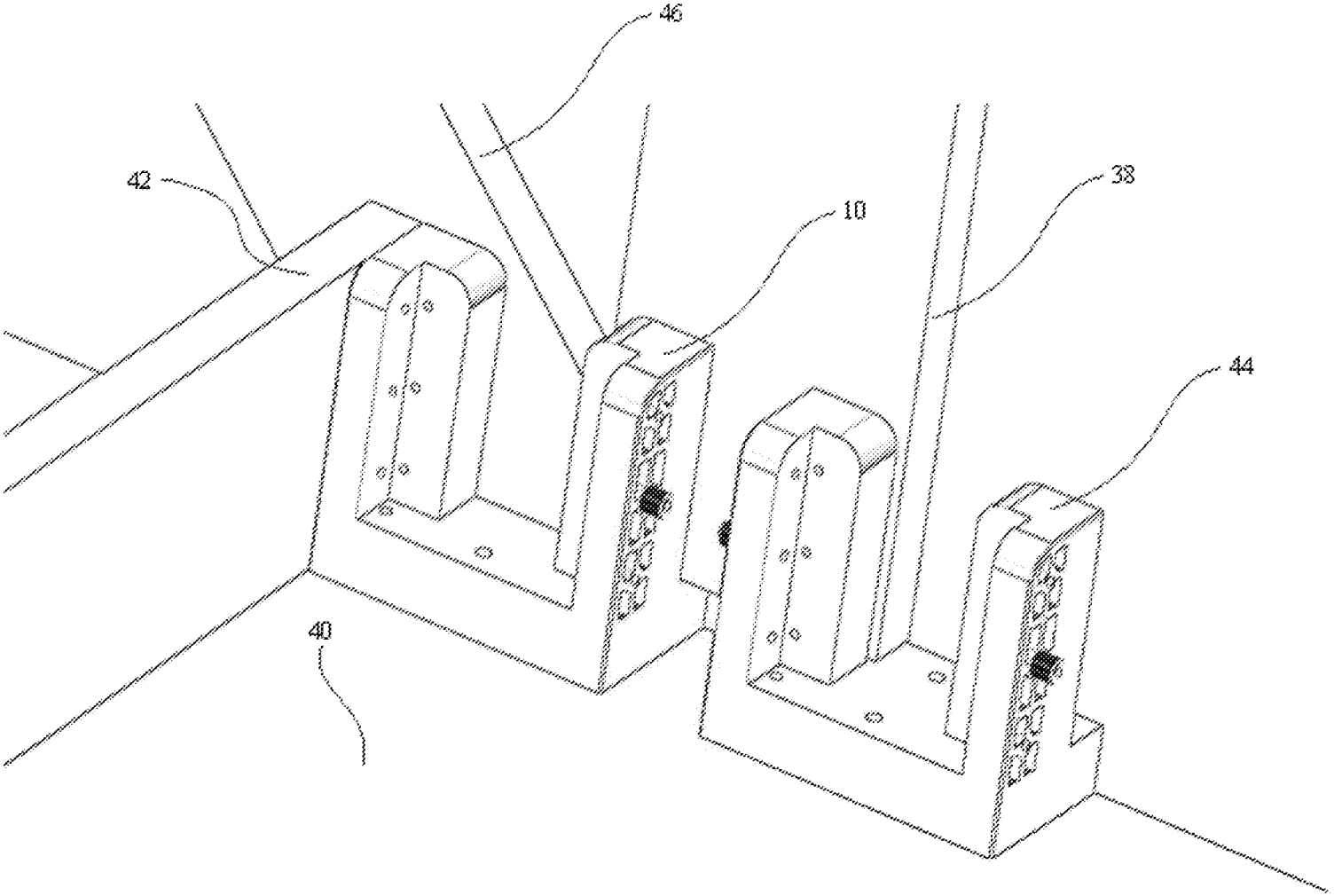
FIG. 9 illustrates several alignment strategies using a load transmitter jig.

An example of an assembly with a load transmitter jig 10 connected to several components is illustrated in FIG. 9.

The first component 38 and second component 40 are external features that are external to the load transmitter jig 10 and are components of the assembly, for example a shipping pallet or a structural beam to be assembled on top of the shipping pallet using the load transmitter jig 10. However, any external feature or component may be used, such as external plates to be assembled in a cuboid structure, or the like.

As described above with reference to the fixation member 10 or the load transmitter jig 10, protruding features or holes may be used during the mounting of the components to the load transmitter jig 10. For example, the mounting of the load transmitter jig 10 to the first component 38 may comprise engaging a hole of the first component 38 with a cavity protrusion 24*a*,24*b* extending from a base surface 18*a*,18*b* of the first L-shaped projection 16*a* or the second L-shaped projection 16*b*.

As a further example, the mounting of the load transmitter jig 10 to the first component 38 may comprise aligning the first component 38 in a beam fixation cavity 23 formed by the top surface 14 of the principal plate 12 and a base surface 18*a*, 18*b* of the first L-shaped projection 16*a* or the second L-shaped projection 16*b*, or a base surface 18*a*, 18*b* of both the first L-shaped projection 16*a* and the second L-shaped projection 16*b*.

Further, mounting the second component 40 to the bottom surface 22 of the principal plate 12 may comprise engaging a hole of the second component 40 with a bottom protrusion 26*a*,26*b* extending from the bottom surface 22 of the principal plate 12.

Furthermore, the method may comprise mounting a third component 42 to a flank protrusion 28*a*,28*b* of the load transmitter jig 10, wherein the flank protrusion 28*a*,28*b* engages a hole of the third component 42, and wherein the flank protrusion 28*a*,28*b* extends from the first L-shaped projection 16*a* or the second L-shaped projection 16*b*.

In some examples, several load transmitter jigs 10 may be used in an assembly. For example, several identical load transmitter jigs 10 may be used to construct and align a packaging assembly, wherein several assembly strategies may be used with the load transmitter jigs 10.

As an example, the method may comprise mounting a second load transmitter jig 44 to a packaging support structure, such as the example of the second component 40 shown in FIG. 9, and mounting the first component 38 to the second load transmitter jig 44. The second load transmitter jig 44 may be generally similar or identical to the load transmitter jig 10, and hence reference is made to the above description. In some examples, the second load transmitter jig 44 is aligned with the load transmitter jig 10. In other examples, the second load transmitter jig 44 is not aligned with the load transmitter jig 10, such as being arranged at an opposite end of the first component.

As described with reference to the fixation member 10 and the load transmitter jig 10 above, a bottom protrusion of the second load transmitter jig 44 may engage a hole of the packaging support structure and/or a cavity mounting protrusion of the second load transmitter jig 44 may engage a further hole of the first component 38, wherein the bottom protrusion and the cavity mounting protrusion may be arranged at different sides of the second load transmitter jig 44.

It is therefore possible to connect one component to several load transmitter jigs 10,44 to construct the assembly. In addition, it is possible to connect several components to the same orientation or surface of the load transmitter jig 10.

For example, the method may comprise mounting a fourth component 46 to the load transmitter jig 10, wherein a first surface of the fourth component 46 contacts a base surface 18*a*,18*b* of the first L-shaped projection 16*a* or the second L-shaped projection 16*b*, and a second surface of the fourth component 46 contacts the top surface 14 of the principal plate 12, wherein the first surface and the second surface may be different.

In addition, a third surface of the fourth component 46, which may be different from the first surface and the second surface, may contact a third surface of the first component 38, wherein the first component 38 and the fourth component 46 are connected to the same load transmitter jig 10.

Additionally, a further cavity mounting protrusion 24*a*, 24*b* of the load transmitter jig 10 may engage a hole of the fourth component 46. The cavity protrusion 24*a*,24*b* and the further cavity protrusion 24*a*,24*b* may each extend from different base surfaces 18*a*,18*b* each corresponding to the first L-shaped projection 16*a* and the second L-shaped projection 16*b*, respectively.

Moreover, the method may comprise mounting a fifth component to a further cavity 35 or further mounting space of the first load transmitter jig 10, wherein the further cavity 35 is formed by two inner surfaces 36*a*,36*b* of each of the first L-shaped projection 16*a* and the second L-shaped projection 16*b*, and the top surface 14 of the principal plate 12.

Figure 10:
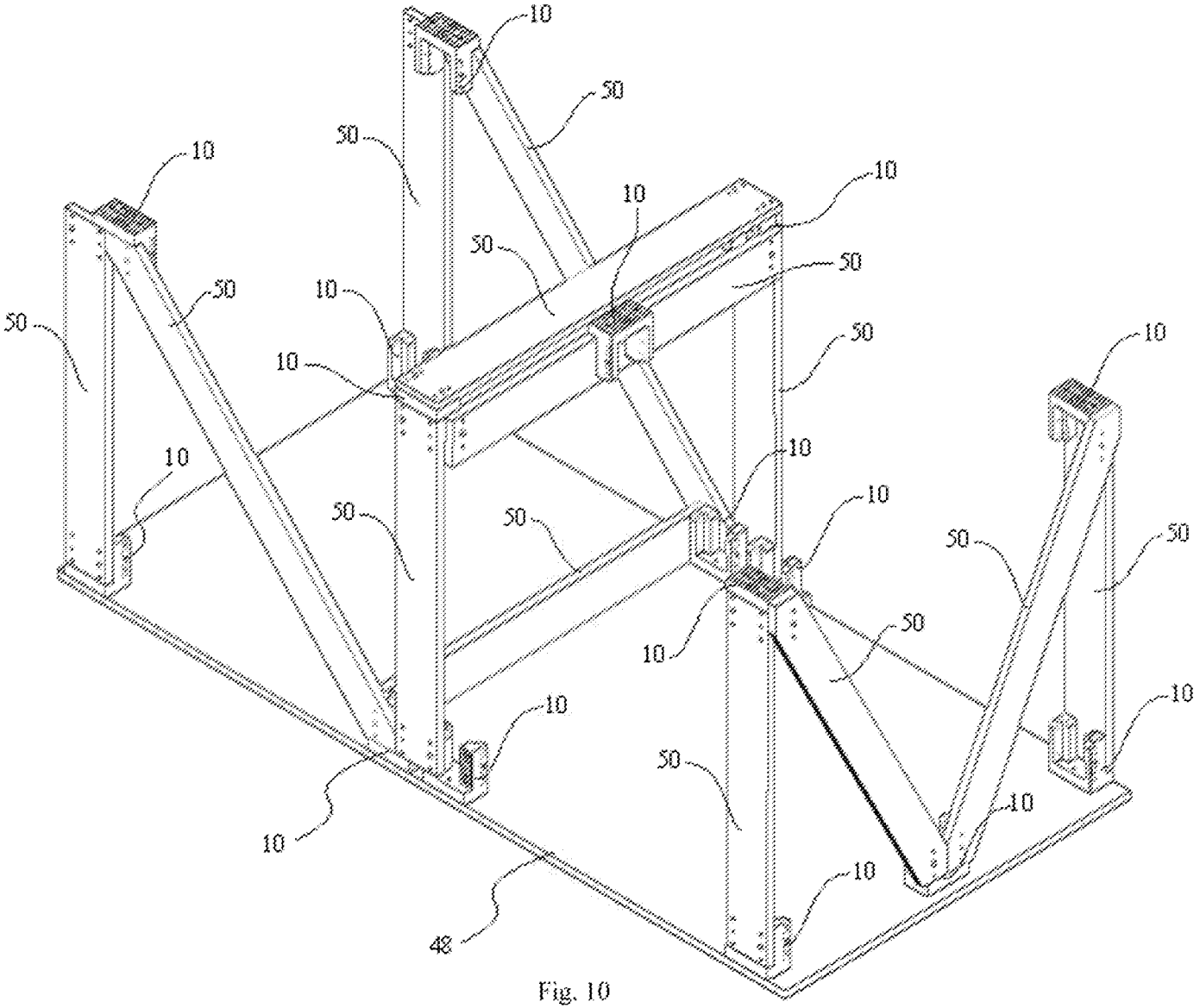
FIG. 10 illustrates further alignment strategies using a load transmitter jig.

Some of the above mentioned mounting options are illustrated in FIG. 10, wherein a packaging support structure on top of a plate 48 is formed by a plurality of beams 50 each connected to load transmitter jigs 10. However, several other alignment options may be derived from the description of the fixation member 10 or the load transmitter jig 10 above.

In addition, the method may comprise fixing an external feature to the load transmitter jig 10 with a connection piece, such as a screw or the like. However, a rigid connection may also be established by a positive-locking or interlocking piece of the load transmitter jig 10 or by a firm bond, such as a glue connection.

The invention claimed is:

1. A fixation member comprising:

a support structure comprising a top surface and opposing side surfaces;

a first L-shaped projection extending from the top surface of the support structure;

a second L-shaped projection extending from the top surface of the support structure, wherein the first L-shaped projection and the second L-shaped projection each comprise a base surface and a side surface, and wherein the first and the second L-shaped projections are arranged with mirror symmetry with respect to a plane intersecting and perpendicular to the opposing side surfaces of the support structure.

2. The fixation member of claim 1, wherein the fixation member is a one-piece fixation member.

3. The fixation member of claim 1, wherein the first and the second L-shaped projections are further arranged with mirror symmetry with respect to another plane perpendicular to the top surface of the support structure.

4. The fixation member of claim 1, wherein either or both of the side surface of the first L-shaped projection and the side surface of the second L-shaped projection are aligned with an edge of the support structure.

5. The fixation member of claim 1, wherein the base surface of the first L-shaped projection and/or the base surface of the second L-shaped projection is not aligned with an edge of the support structure.

6. The fixation member of claim 1, further comprising:

a mounting protrusion comprising one or multiple of a base-side mounting protrusion extending from the base surface of the first L-shaped projection or the base surface of the second L-shaped projection, a bottom-side mounting protrusion extending from a bottom surface of the support structure, and a flank mounting protrusion extending from the side surface of the first L-shaped projection or the side surface of the second L-shaped projection.

7. The fixation member of claim 1, further comprising:

a fixation hole penetrating the fixation member between surfaces of the fixation member, wherein one of the surfaces is the top surface, the base surface, or the side surface.

8. The fixation member of claim 1, wherein the fixation member comprises a plurality of voids in the L-shaped projection and the support structure, the voids defining a plurality of webs between adjacent voids.

9. A load transmitter jig comprising:

a principal plate with a top surface and a bottom surface on opposite sides of the principal plate;

a first L-shaped projection extending from the top surface of the principal plate;

a second L-shaped projection extending from the top surface of the principal plate; and a beam fixation cavity formed by a portion of the top surface of the principal plate and a common plane defined by parallel base surfaces of the first L-shaped projection and the second L-shaped projection, wherein the beam fixation cavity comprises a cavity mounting protrusion, the cavity mounting protrusion extending from the common plane of the first L-shaped projection and the second L-shaped projection, wherein the first L-shaped projection and the second L-shaped projection define a further cavity opposite of the beam fixation cavity, and wherein the further cavity is formed by two inner surfaces of each of the first L-shaped projection and the second L-shaped projection, and the top surface of the principal plate.

10. The load transmitter jig of claim 9, further comprising:

a flank mounting protrusion extending from the first L-shaped projection or the second L-shaped projection in a different direction than the cavity mounting protrusion.

11. The load transmitter jig of claim 9, further comprising:

a bottom mounting protrusion extending from the bottom surface of the principal plate, the bottom surface being opposite the top surface.

12. A method for aligning components of a packaging assembly, comprising:

mounting a load transmitter jig to a first component of the packaging assembly, wherein the load transmitter jig comprises a principal plate, and a first L-shaped projection and a second L-shaped projection extending from a top surface of the principal plate, wherein a first surface of the first component contacts a base surface of the first L-shaped projection or the second L-shaped projection, and a second surface of the first component different from the first surface contacts the top surface of the principal plate; and mounting a second component of the packaging assembly to a bottom surface of the principal plate, the bottom surface being opposite the top surface.

13. The method of claim 12, wherein mounting the load transmitter jig to the first component comprises:

engaging a hole of the first component with a cavity protrusion extending from a base surface of the first L-shaped projection or the second L-shaped projection.

14. The method of claim 12, further comprising:

mounting a third component of the packaging assembly to a flank protrusion of the load transmitter jig, wherein the flank protrusion engages a hole of the third component, and wherein the flank protrusion extends from a side surface of the first L-shaped projection or the second L-shaped projection.

15. The method of claim 12, further comprising:

mounting a fourth component of the packaging assembly to the load transmitter jig, wherein a first surface of the fourth component contacts a base surface of the first L-shaped projection or the second L-shaped projection, and a second surface of the fourth component contacts the top surface of the principal plate.

* * * * *